US006082063A

United States Patent [19]

Shrive et al.

[11] Patent Number: 6,082,063

[45] **Date of Patent: *Jul. 4, 2000**

[54] PRESTRESSING ANCHORAGE SYSTEM FOR FIBER REINFORCED PLASTIC TENDONS

[75] Inventors: Nigel G. Shrive; Ezzeldin Y. Sayed-Ahmed; Eric Damson; Daniel Tilleman; Gamil Tadros, all of Calgary, Canada

[73] Assignee: University Technologies International Inc., Alberta, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,186

[22] Filed: Nov. 21, 1996

[51] Int. Cl.[7] ..... E04C 5/08; E04G 21/12

[52] U.S. Cl. ..... 52/223.13; 52/223.7; 52/223.14

[58] Field of Search ..... 52/223.1, 223.6, 52/223.7, 223.13, 223.14

[56] References Cited

U.S. PATENT DOCUMENTS

| | | | |
|---|---|---|---|
| 2,180,866 | 11/1939 | Cryer | 52/223.14 X |
| 3,522,682 | 8/1970 | Howlett et al. | 52/223.13 |
| 3,935,685 | 2/1976 | Howlett . | |
| 4,307,550 | 12/1981 | Behar | 52/23.13 |
| 4,621,943 | 11/1986 | Swanson | 52/223.13 X |
| 4,662,134 | 5/1987 | Illgner | 52/223.13 |
| 4,837,995 | 6/1989 | Omizono et al. | 52/223.13 |

OTHER PUBLICATIONS

Fibre Reinforced Plastic (FRP) Prestressed Masonry, N.G. Shrive, E.Y. Sayed–Ahmed, E. Damson and G. Tadros, 11 pages, Proceeding of the 1996 CSCE annual conference, May–Jun., 1996, Edmonton.

Anchorage of Non–Metallic Prestressing Tendons, Lars Eric Holte, Dr. Charles W. Dolan, Dr. Richard J. Schmidt, Department of Civil and Architectural Engineering, University of Wyoming, Laramie, WY 82071, Technical Report, UWYO–CE–93.1, Jul., 1993, Chapter 2, pp. 4–15.

Cable and Anchorage Technology, State of–the–art Report, Final Draft Copy, Task 6: Cable and Anchorage Technology, Prepared by: Hercules Aerospace Co. with support from Team Members: Amoco, Dupont, JMI, University of California, SanDiego, pp. 32–38, Jan. 17, 1995.

Principles of Design of FRP Tendons and Anchorages for Post–Tensioned Concrete, by F.S. Rostasy and H. Budelmann, Fiber–Reinforced Plastic Reinforcement for Concrete Structures, Int. Symposium, UCI, 1993., pp. 632–649.

(List continued on next page.)

*Primary Examiner*—Beth A. Aubrey
*Assistant Examiner*—Kevin D. Wilkens
*Attorney, Agent, or Firm*—Anthony R. Lambert

[57] ABSTRACT

An anchorage for a tendon that includes a sleeve having a smooth tapered interior bore and a compressible wedge disposed in the sleeve. The compressible wedge has a smooth exterior tapered surface tapering from a wider end to a narrower end and one or more interior channels for receiving a tendon. The taper angle of the compressible wedge is greater than the taper angle of the bore. Thus, upon insertion of the compressible wedge into the sleeve, the wider end of the compressible wedge forms a wedge contact with the sleeve before the narrower end forms a wedge contact with the sleeve. Preferably, the bore and wedge are conical, and the wedge is formed of several symmetrical pie shaped resilient sections. Corners of the sections abutting at the interior channel are rounded. An inner sleeve is disposed in the interior channel, with the outer diameter of the inner sleeve matching the diameter of the interior channel. The tendon is held by the inner sleeve. A pre-stressed structure may be formed by anchorages at each end of a structure with a tendon in tension between them.

8 Claims, 3 Drawing Sheets

OTHER PUBLICATIONS

Design, Testing and Modeling of an Anchorage System for Resin Bonded Fibreglass Rods Used as Prestressing Tendons, T.M. Sippel, Stuttgart, Germany, Advanced Composite Materials in Bridges and Structures, 1992, 9 pages.

Extending the Life of Cables by the Use of Carbon Fibers, Urs Meier, IABSE Symposium, San Francisco, 1995, pp. 1235–1240.

Design and Analysis of Anchoring Systems for a Carbon Fiber Composite Cable, J.F. Noisternig and D. Jungwirth, Advanced Composite Materials in Bridges and Structures, Canadian Society for Civil Engineering, Montreal, Quebec, 1996, pp. 934–943.

Performance of FRP Tendon–Anchor Systems for Prestressed Concrete Structures, Antinio Nanni, Charles E. Bakis, Edward F. O'Neil, Troy O. Dixon, PCI Journal, vol. 41, No. 1, Jan./Feb. 96, pp. 34–43.

The Development and Application of a Ground Anchor Using New Materials, S. Mochida, T. Tanaka and K. Yagi, Advanced Composite Materials in Bridges and Structures, Canadian Society for Civil Engineering, 1992, 12 pages.

The Anchorage Mechanism for FRP Tendons Using Highly Expansive Material for Anchoring, Myo Khin, T. Harada, S. Tokumitsu, T. Idemitsu, Advanced Composite Materials in Bridges and Structures, Canadian Society for Civil Engineering, Montreal, Quebec, 1996, pp. 958–965.

Performance of FRP Tendon Anchor Sysetms for Prestressed Concrete Structures, PCI Journal, vol. 41, No. 1, Jan.–Feb. 1996.

Anchorage of Non–Metallic Prestressing Tendons, Lars Eric Holte, Dr. Charles W. Dolan, Dr. Richard J. Schmidt, Department of Civil and Architectural Engineering, University of Wyoming, Laramie, WY 82071, Technical Report, UWYO–CE–93.1, Jul., 1993.

PRESTRESSING ANCHORAGE SYSTEM FOR FIBER REINFORCED PLASTIC TENDONS

FIELD OF THE INVENTION

This invention relates to anchorage systems used for anchoring tendons used for prestressing structural elements.

CLAIM TO COPYRIGHT

Not applicable

CROSS-REFERENCE TO OTHER APPLICATIONS

Not applicable

REFERENCE TO MICROFICHE APPENDIX

Not applicable

BACKGROUND OF THE INVENTION

Masonry is frequently used as an "expensive" exterior wall decoration, with complete disregard for its structural properties. In general, masonry, like concrete, is very strong in compression but very weak in tension. One method to overcome this structural deficiency is to reinforce masonry with steel bars, similar to reinforced concrete. Another approach, which looks more attractive in the case of masonry, is to use prestressing. For example, Curtin et al (1982) show that for a 20% increase in cross sectional area, a diaphragm wall can have 15 times the bending resistance of a cavity wall. Post-tensioning will provide a further increase in resistance, perhaps up to 150 times that of the original cavity wall.

It is believed that the simplest, yet most effective and cheapest technique of prestressing masonry is post-tensioning with unbonded steel tendons. However, serious problems have been reported regarding the performance of unbonded steel tendons used for post-tensioned masonry and, in general, concrete structures. One of the most common problems is associated with steel corrosion, even when the "right" protection technique is used. Significant loss of prestressing may occur as a result of the tension corrosion and may lead to catastrophic failure (e.g. Elliott and Morrison, 1995). Thus, what starts as a dream of having an economic and aesthetic structural element may turn into a continuous nightmare of rehabilitation.

As an alternative for steel tendons, new advanced corrosion-free materials have been introduced. These promising new products are Fibre-Reinforced-Plastic (FRP) materials.

In order to use FRP tendons in masonry, an anchorage system must be designed which allows for the development of the full strength of the prestressing cable, but which has minimal creep and loss of loads at transfer. The traditional anchorages for FRP tendons involve either epoxy resins or soft metals between tendon and anchorage. Loss of load due to displacements in these systems is likely to make them inadequate for the "short" spans of masonry. Hence, the first stage for post tensioning masonry with FRP tendons is the development of an appropriate anchorage system.

The concept of making fibre reinforced composite materials for improved performance is very old: in ancient Egyptian civilization straw was used to reinforce clay bricks. Masonry reinforced with iron rods was used in the nineteenth century, leading to the development of reinforced concrete. During the early twentieth century, Phenolic resins reinforced with asbestos fibres were introduced (Daniel and Ishai, 1994).

In the early 1940s, the first fibreglass boat was made, followed by filament winding which was introduced in 1946 and incorporated into missile applications in the 1950s. The first high strength carbon fibres were introduced in the early 1960s and were used in aircraft industry by 1968. KEVLAR™ (or aramid) fibres were later developed in 1973. By the late 1970s advanced composites were utilized widely in the aircraft, automotive, sporting goods and biomedical industries, as well as many other fields. The 1980s marked a significant increase in high-modulus fibre utilization (Daniel and Ishai, 1994).

As a result of their high durability and corrosion resistance, FRP's have been pioneered in recent years (late 1980s and 1990s) as an alternative to prestressing steel tendons, especially in bridges. Most FRP's used today are reinforced with glass (GFRP), aramid (AFRP), and/or carbon (CFRP). Both CFRP and AFRP have been recently used for both pre-and post-tensioned applications. The world's first highway bridge, with a span of 47 m, prestressed with CFRP was build in Germany 1986 (Ballinger, 1991). In 1994, two masonry footbridges were lowered into place in the UK. One of them incorporated PARAFIL™ rope prestressing tendons and the other was prestressed by steel tendons (Shaw and Baldwin, 1995 and Shaw et. al. 1995). In Canada, another bridge prestressed with CFRP tendons was built in Calgary (Grant et. al. 1995).

The typical stress-strain relationships of FRP tendons show that none of them exhibit the inelastic response typical of steel tendons, and thus no ductility is observed in the failure of this kind of material. This shortcoming must be addressed in the design codes before there will be any widespread practical usage of FRP in prestressing applications.

GFRP offers the cheapest alternative to steel tendons where its price is very comparable to steel. However, its mechanical properties are disappointing compared with the other two types of FRP. GFRP has the lowest tensile strength (Holte et. al., 1993a), and is very sensitive to fatigue damage (Multi et. al., 1991). Furthermore, GFRP suffers creep rupture more than the other two types where midterm failure is observed at 33% of the ultimate load compared to 50% and 80% for AFRP and CFRP respectively (Slattery, 1994). GFRP's are also very sensitive to alkaline media and lose much of their strength when exposed to moisture and/or increased temperature (Hercules aerospace, 1995).

Although CFRP is more expensive, it has the more appropriate structural properties. Of the FRP considered, CFRP exhibits the highest tensile strength (Hercules aerospace, 1995), excellent fatigue strength compared with steel tendons (Rostasy et. al., 1993) and very low relaxation (Rao, 1992 and Santoh et. al., 1993). The biggest advantage of CFRP is the high durability and corrosion resistance compared with steel tendons.

In the post-tensioning method, the material is constructed about a tendon which is not bonded to the material. Once the material (either concrete of masonry) gains its strength, the tendon is anchored at one end and a jack is usually used at the other end to stretch the tendon. When the required level of prestressing force is reached, the tendon is anchored with a suitable anchorage system to transfer the prestress to the masonry and/or concrete. The jack is then released. As may be deduced from this sequence, the key-point in the post-tensioning technique is the anchorage system.

FRP tendons are much more sensitive to loads in the transverse direction compared to steel tendons. However, conventional anchorage systems cause stress concentration in the transverse direction around the wedge teeth which will generally lead to cable/rod failure (failure mode type 2). Thus, new anchorage concepts are required for FRP. The most common types of FRP anchorage used to date are (Holt, 1993a,b):

Split wedge. A metal wedge in a conic housing is used to grip the tendon. (Tokyo Rope, 1990 and Iyer et. al., 1991). The main anchorage concept is that the wedges compress the perimeter of the tendon and teeth in the wedges grip it. Wedge teeth lead to fracture of the tendons due to the biting action of the wedge. Enka (1986) used a plastic wedge system but the usage of this system is limited to pre-tensioning prestressing.

Plug in-cone. A bundle of tendons is placed in a conical housing socket. A solid cone (spike) is then driven into the bundle centre to splay out the tendons and gripping them individually between the spike itself and the socket. The system is reported to perform well under a static load (Burgoyne, 1990). The system has the advantage of not using resins around the tendons and thus suffers no creep deformation and is not sensitive to elevated temperature. The main disadvantage of this system with respect to FRP tendons is that the tendons are not straight at the front of the anchorage which may shatter the fibres apart.

Resin-sleeve. An epoxy resin is injected between a cylindrical steel shell (sleeve) and the tendon. The inside surface of the sleeve is usually deformed or threaded to improve the load transfer (Wolff and Miesser, 1989 and Tokyo Rope, 1990). In addition to suffering excessive creep deformation and being sensitive to moisture and thermal loads, rod bond failures were also reported for this anchorage system (Holte et. al., 1993a).

Resin-potted. The resin-sleeve anchorage system is modified to this geometry to achieve better anchorage. The resin-potted anchorage system is actually a combination of the split wedge system and the resin sleeve system where the compressive action of the split wedge is developed while the continuous bond of the resin releases the biting action of the teeth. However, creep deformation and sensitivity to thermal loading and moisture are still major problems for this type of anchorage (Dolan, 1991 and Iyer et. al. 1991).

Soft-metal overlay. This anchorage is used by Tokyo Rope (1990). The gripping pressure is transferred to the FRP rods through a soft metal tube (sleeve). With this configuration the metal sleeve is permanently bonded to the cable and gripping is achieved using a conventional strand chuck. Typically the soft metal is aluminum or an aluminum alloy. These materials corrode in concrete and are thus unsuitable for use in masonry as well.

Swaged anchor. In this type, the rod/cable is embedded in a resin and transverse stress is generated along a steel shell using bolts and nuts. Increased friction along the surface of the tendons is generated and provides the required gripping (Sippel, 1992).

From an understanding of the prior art as set out above, the inventors have identified requirements for post-tensioning prestressing anchorage system for masonry, as follows:

The anchorage must develop the maximum tensile capacity of the prestressing strands: that is the tendon should fail at its maximum capacity rather than slip out of the anchorage, fail prematurely or cause anchorage failure. The system should develop a minimum of 95% of the ultimate tensile strength of the tendon which is referred as the anchorage efficiency: this is a major requirement for the anchorage. The anchorage must also allow correlation between the prestressing force and the elongation of the tendons.

At the release of the jacking force, the anchorage must undergo a very small, predictable deflection. This is because a large deflection would reduce the load in the tendon substantially, particularly in the "short" lengths which may be expected in masonry walls.

The anchorage must perform at the same level throughout the lifetime of the structure. The stressing operation should only have to be performed once. Thus creep in the anchorage must be minimal.

In addition, the inventors have identified that the most common failure modes of FRP anchorage systems can be summarized as follows:

Rupture of the cable-rod within its free length. This mode is the one which indicates that the anchorage is working as planned. It demonstrates that the tensile capacity of the FRP cable/rod is totally developed.

Shear failure in the anchorage zone. The cable/rod may be pinched due to the large shear stress concentration that occurs with certain anchorage geometries. The shear stress causes premature failure of the tendon.

Bond failure between the epoxy and the cable/rod (for epoxy anchorage systems: eg. Type 3 or 4 anchorages defined above). Due to bond failure, no load transfer occurs between the cable/rod and the anchorage which causes this type of failure.

Excessive deflection and/or long-term creep. The low elasticity modulus epoxy resin (epoxy anchorage system) is very sensitive to high temperature and exhibits long term creep deformation as well. As a result, the undesired longitudinal deformation resulting from these two shortcomings may lead to significant loss of prestress force.

Slip failure between the cable/rod and the grip. This type of failure is catastrophic and leads to complete loss of prestressing force due to cable/rod pulling out from the anchorage.

SUMMARY OF THE INVENTION

The inventors have developed a new anchorage which does not have the disadvantages mentioned above while simultaneously satisfying the requirements for a post-tensioning anchorage system for application to a variety of structures.

The new anchorage is resin-free and is very easy to put together in the field: it requires no new or advanced technology either to manufacture or use.

There is therefore provided in accordance with one aspect of the invention an anchorage for a tendon that includes a sleeve having a smooth tapered interior bore, and a compressible wedge disposed in the sleeve. The compressible wedge has a smooth exterior tapered surface tapering from a wider end to a narrower end and an interior channel disposed symmetrically within the compressible wedge for receiving a tendon. The taper angle of the compressible wedge is greater than the taper angle of the bore. Thus, upon insertion of the compressible wedge into the sleeve, the wider end of the compressible wedge forms a wedge contact with the sleeve before the narrower end forms a wedge contact with the sleeve.

Preferably, the bore and wedge are conical, and the wedge is formed of several symmetrical pie shaped resilient sections. In a still further aspect of the invention, corners of the sections abutting at the interior channel are rounded.

In a still further aspect of the invention, an inner sleeve is disposed in the interior channel, with the outer diameter of the inner sleeve matching the diameter of the interior channel. In this construction, the tendon is held by the inner sleeve.

In a further aspect of the invention, more than one tendon may be held within the compressible wedge, preferably with the wedge being formed of resilient pieces distributed symmetrically about the tendons.

In a still further aspect of the invention, a structure is placed in compression using anchorages according to the invention.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
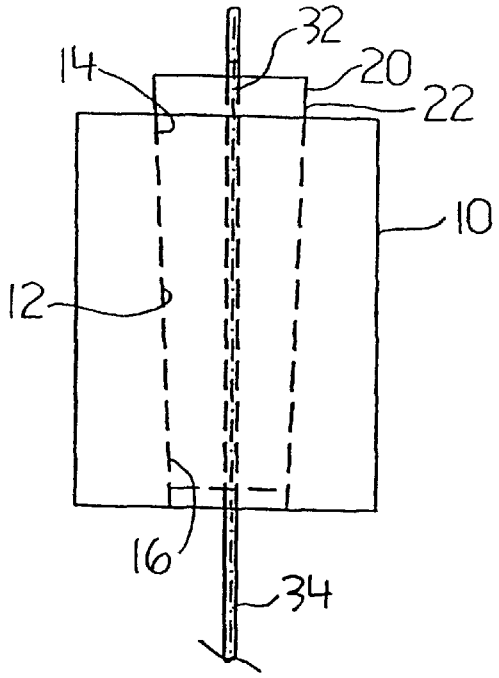
FIG. 1 is a side view of a sleeve according to the invention party in section with a tapered bore and inner wedge shown in dotted lines.
Figure 1A:
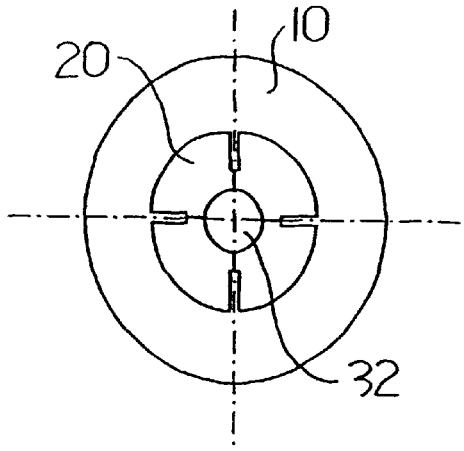
FIG. 1A is a section through the sleeve of FIG. 1 perpendicular to axis A.
Figure 2:
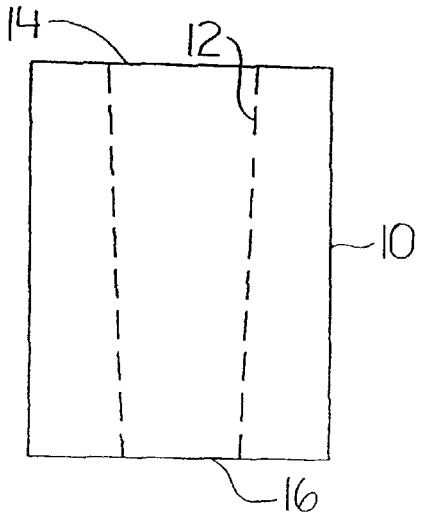
FIG. 2 is a side view of the sleeve of FIG. 1.

Referring to FIGS. 1, 1A and 2, an anchorage for a tendon according to the invention is formed of an outer sleeve 10, which may be a steel cylinder, having a smooth tapered interior bore 12. The bore 12 receives a compressible wedge 20 having an interior channel 32. The smooth tapered interior bore 12 is shown in its preferred shape as a truncated cone, but it is only necessary that the interior bore 12 tapers from a wider end 14 to a narrower end 16 in a plane (such as the plane of the sheet containing the figures) that includes the interior channel 32. That is, the cross-section of the bore 12, perpendicular to the axis A, need not be circular, but could be rectangular, or other polyhedral shape. The taper of the bore 12 also need not taper at a constant angle, nor need it be continuous, although a constant continuous taper as shown is preferred. For example, the taper could be stepped, or could gradually curve from a greater to a lesser taper. The bore 12 is very smooth and grease is added to facilitate the movement between this sleeve and an inner wedge 20.

Figure 3:
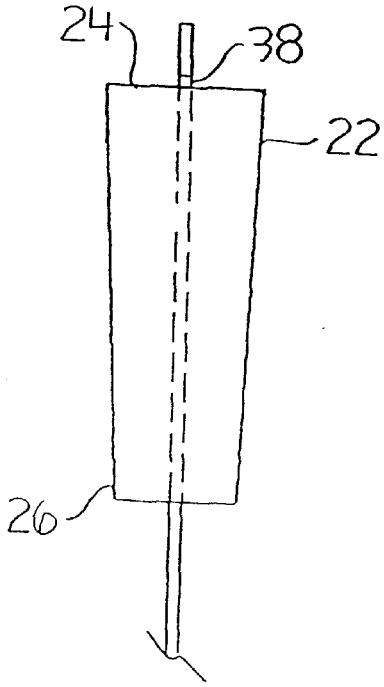
FIG. 3 is a side view of the wedge of FIG. 1.
Figure 4:
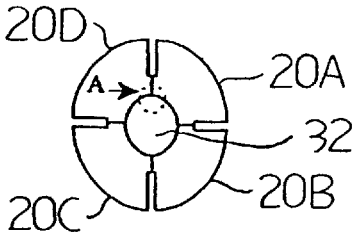
FIG. 4 is a section through the wedge of FIG. 3 with an interior channel.
Figure 5:
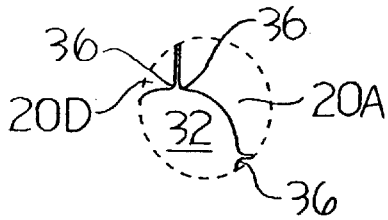
FIG. 5 is a detail of the interior channel of the wedge shown in FIG. 4.

The inner wedge 20, shown in FIGS. 1 and 3, is shaped to fit in the bore 12 of the sleeve 10, and has a smooth exterior tapered surface 22 tapering from a wider end 24 to a narrower end 26. The wedge 20 is compressible, which may be obtained by the wedge 20 being, as shown in FIG. 4, made of four resilient pieces 20A, 20B, 20C and 20D disposed symmetrically around the interior channel 32 to form a radially split tapered wedge. Symmetry helps to ensure even stress distribution on a tendon 34 in the wedge. The wedge 20 has an interior channel 32, disposed so that, when the wedge 20 is inserted in the sleeve 10, tensile forces on a tendon 34 during use are oriented along the interior channel 32. The boundary surface of the interior channel 32 is sand blasted, and the corners 36 of the wedge pieces 20A, 20B, 20C and 20D abutting the interior channel 32 are rounded as shown in FIG. 5 to reduce the stress concentration on the tendon 34 when the wedge 20 is seated inside the outer sleeve 10.

The smooth exterior tapered surface 22 of the compressible wedge 20 tapers to a greater extent than the smooth tapered interior bore 12 at least in a first plane that includes the interior channel 32, such that upon insertion of the compressible wedge 20 into the sleeve 10, the wider end 24 of the compressible wedge 20 forms a wedge contact with the sleeve 10 before the narrower end 26 forms a wedge contact with the sleeve 10. Hence, in the case of a conical bore 12 and conical four piece steel wedge 20, the angle of inclination of the outer surface 22 of the wedge is slightly larger, for example 2.0° to 2.2°, than the angle of the inner surface 12 of the outer sleeve 10, which may be for example 1.95° to 2.0°. The angle of the inner surface 12 and the angle of the outer surface 22 (both measured in relation to the central axis A) may range from low angles near 1° to higher angles at 15° and higher. The difference between the angle of the inner surface 12 and the angle of the outer surface 22 is preferably in the range from 0.05° to 0.25°. The lower limit of the difference in the angles is governed by the requirement that the larger end of the wedge contact the bore before the smaller end of the wedge contacts the bore. In the case of a truncated conical wedge and bore, the difference in the apical angles of the conical wedge and the conical bore will be preferably in the range 0.1° to 0.5°. At apical angular differentials higher than about 0.5°, the wedge begins to dig too much into the tendon, and increase the risk of rupture.

Figure 6:
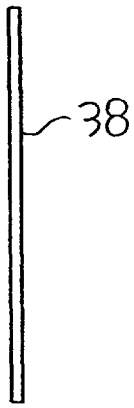
FIG. 6 is a side view of an inner sleeve for encasing a tendon to be received by the anchorage.

Preferably, a tendon 34 is first encased in an inner sleeve 38, shown in FIG. 6, whose outer diameter is the same as the diameter of the interior channel 32 in the wedge 20.

The inner sleeve 38 may be made out of steel or copper and has a small wall thickness, for example 1/200 of the diameter of the inner sleeve 38. The inner diameter of the sleeve 38 is drilled to the diameter of the tendon 34. The outer surface of the sleeve 38 is sand-blasted.

The small differential slope between the taper of the bore 12 of the outer sleeve 10 and the taper of the outer surface 22 of the wedge 20 distributes the pressure on the prestressing strand or tendon 34 more evenly over the length of the anchorage, than a normal steel one with the same angle on the conical hole and the wedge spike. In the latter case there is high stress concentration near the leading edge of the tendon, which tends to break FRP tendons.

The rounded corners 36 of the surface defining the interior channel 32 in the four piece wedge removes the stress concentration caused by a sharp corner. The pieces of the wedge 20 therefore do not dig into the FRP tendon, thus reducing the likelihood of premature failure.

While a two piece wedge 20 is possible, it is preferred that the wedge 20 have at least three sections, and preferably four. It is preferred that the taper of the smooth tapered interior bore 12 is symmetric about the axis of symmetry A of the sleeve 10, but one side could taper to a greater extent than the other. The interior channel 32 need not be disposed exactly along the axis of symmetry A, providing stress distributions on a tendon 34 in the wedge 20 are evenly distributed.

It is very important to note also, that different materials than steel and copper can be used for the anchorage.

Figure 7:
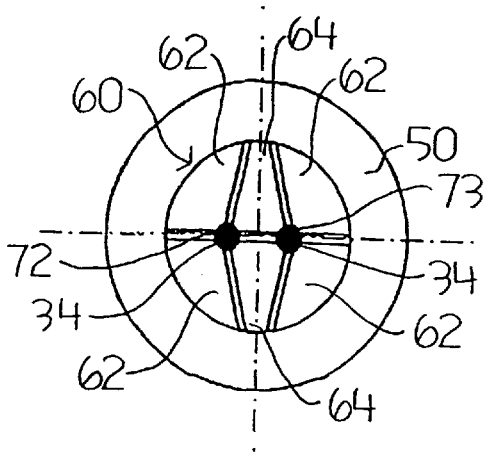
FIG. 7 is a plan view of an anchorage with two interior channels for holding two tendons.
Figure 8:
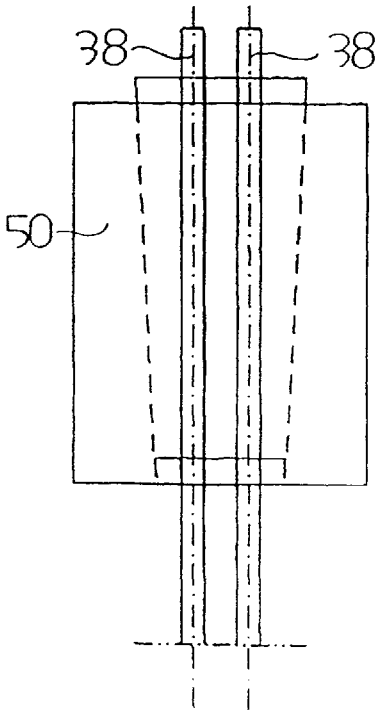
FIG. 8 is a side elevation of the embodiment of FIG. 7.
Figure 9:
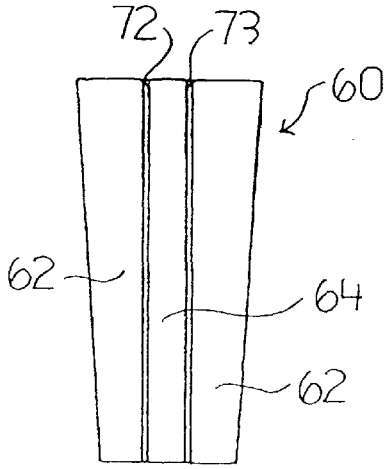
FIG. 9 is a section through a compressible wedge for use in the embodiments of FIGS. 7 and 8.

Referring to FIGS. 7, 8 and 9, a second embodiment according to the invention is shown. Sleeve 50 has the same shape as sleeve 10. Compressible wedge 60 has two interior channels 72, 73 disposed symmetrically within the compressible wedge 60 and lying parallel to each other. The compressible wedge 60 is formed of six resilient sections 62, 64. Interior corners of the resilient sections 62, 64 are rounded. As with the embodiment of FIGS. 1–6, tendons 34 are inserted in inner sleeves 38 before being held by the compressible wedge 60.

Figure 10:
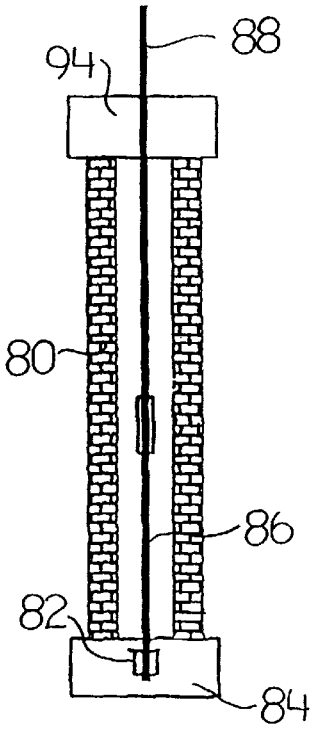
FIGS. 10–14 are sections through a structure progressively showing the emplacement of anchorages and the prestressing of the structures.

Referring to FIGS. 10–14, one or more walls 80, made of brick in this example and shown in cross-section, form a structure having high compressive strength, but low tensile strength. As shown in FIG. 10, an anchorage 82, made in accordance with the invention, is first fixed in a bottom beam 84 at one end of the walls 80 in conventional manner. A tendon 86 is anchored in the anchorage 82, and extends to the other end of the walls 80, leaving excess free tendon beyond the end of the wall 80 as shown at 88.

Figure 11:
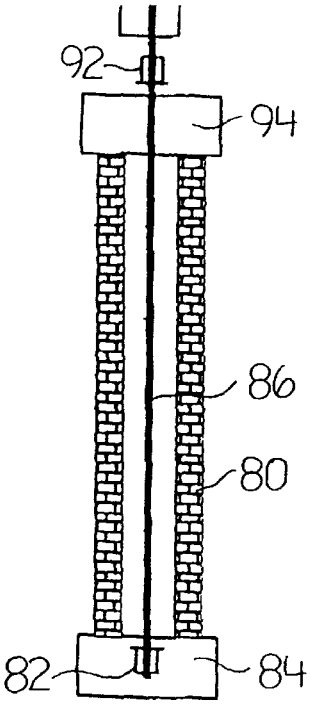
Figure 12:
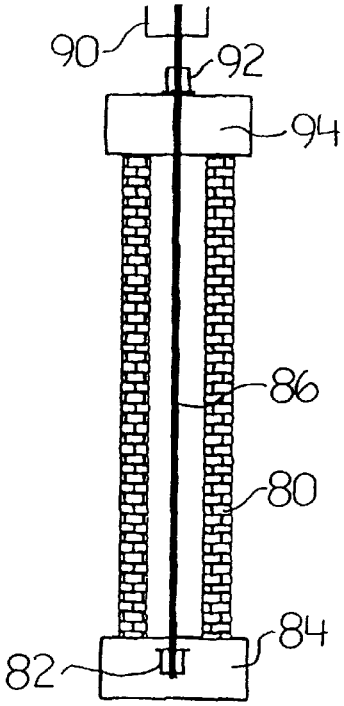
Figure 13:
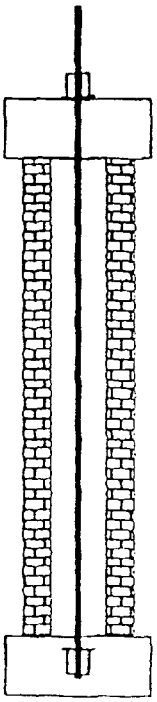
Figure 14:
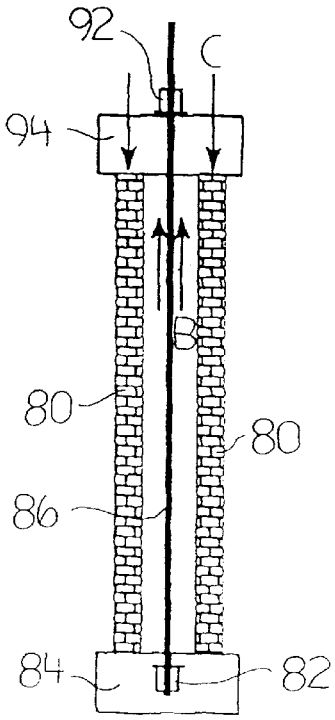

As shown in FIG. 11, a hydraulic jack 90 is attached to the free end of the tendon 86, with the tendon 86 passing through a top anchorage 92 that is slidably attached to the tendon 86. Tension is placed on the tendon 86 with the jack 90. As shown in FIG. 12, the top anchorage 92 is then fixed to the top beam 94 for example with bolts. As shown in FIGS. 13 and 14, the jack 90 is released by cutting the tendon 86. As the tendon 86 shortens it pulls its sleeve 38 with it, and this in turn pulls the compressible wedge 20 into a wedge contact (opposed sides touching) with the bore 14 of the sleeve 10. Sand blasting of the inner sleeve surfaces and the interior channel of the compressible wedge helps to ensure a friction fit of the tendon in the compressible wedge. As the compressible wedge 20 contacts the sleeve 10, it compresses, binding the tendon to a greater extent. Tension as indicated by arrows B in the tendon 86 causes compression as indicated by arrows C in the walls 80, thus forming a pre-stressed structure.

A person skilled in the art could make immaterial modifications to the invention described in this patent document without departing from the essence of the invention that is intended to be covered by the scope of the claims that follow.

What is claimed is:

1. An anchorage for a tendon, the anchorage comprising:

a sleeve having a smooth tapered interior bore;

a compressible wedge disposed in the sleeve, the compressible wedge having a smooth exterior tapered surface tapering from a wider end to a narrower end and a first interior channel disposed within the compressible wedge for receiving a tendon, the interior channel being disposed such that tensile forces on the tendon during use are oriented along the interior channel;

the smooth exterior tapered surface of the compressible wedge tapering to a greater extent than the smooth tapered interior bore at least in a first plane that intersects the first interior channel, such that upon insertion of the compressible wedge into the sleeve, the wider end of the compressible wedge forms a wedge contact with the sleeve before the narrower end forms a wedge contact with the sleeve;

a tubular inner sleeve disposed in the first interior channel, the outer diameter of the inner sleeve matching the diameter of the first interior channel; and a tendon held within the inner sleeve without resin being located within the inner sleeve, the inner diameter of the inner sleeve matching the diameter of the tendon.

2. An anchorage for a tendon, the anchorage comprising:

a tendon;

a sleeve having a truncated conical bore;

a radially split conical wedge seated in the sleeve, the radially split conical wedge having a first interior channel disposed within the radially split conical wedge, the tendon being received within the first interior channel and the first interior channel being disposed such that tensile forces on the tendon during use are oriented along the first interior channel;

the conical wedge having a greater taper angle than the bore of the sleeve; and a tubular inner sleeve in the first interior channel whose outer diameter matches the diameter of the first interior channel, and the inner diameter of the tubular inner sleeve matching the diameter of the tendon, the tendon being secured in the tubular inner sleeve without resin being located within the inner sleeve.

3. An anchorage for a tendon, the anchorage comprising:

a sleeve having a smooth tapered interior bore;

a compressible wedge disposed in the sleeve, the compressible wedge having a smooth exterior tapered surface tapering from a wider end to a narrower end and a first interior channel disposed within the compressible wedge for receiving a tendon, the interior channel being disposed such that tensile forces on the tendon during use are oriented along the interior channel;

the smooth exterior tapered surface of the compressible wedge tapering to a greater extent than the smooth tapered interior bore at least in a first plane that intersects the first interior channel, such that upon insertion of the compressible wedge into the sleeve, the wider end of the compressible wedge forms a wedge contact with the sleeve before the narrower end forms a wedge contact with the sleeve;

an inner sleeve disposed in the first interior channel, the outer diameter of the inner sleeve matching the diameter of the first interior channel;

a tendon held within the inner sleeve without resin located within the inner sleeve; and the smooth tapered interior bore having a first taper angle and the compressible wedge having a second taper angle, and the first taper angle differs from the second taper angle by more than 0.05° and less than 0.20°.

4. The anchorage of claim 3 in which the compressible wedge is composed of resilient sections disposed about the first interior channel.

5. The anchorage of claim 4 in which the compressible wedge is composed of at least three sections disposed symmetrically about the first interior channel.

6. The anchorage of claim 3 in which the smooth tapered interior bore is conical.

7. The anchorage of claim 6 in which the compressible wedge is conical and composed of resilient sections disposed about the first interior channel.

8. The anchorage of claim 7 in which the compressible wedge is composed of at least three sections disposed symmetrically about the first interior channel.

* * * * *